US006019613A

United States Patent [19]

Kataoka et al.

[11] Patent Number: 6,019,613

[45] Date of Patent: Feb. 1, 2000

[54] CONNECTOR FOR PRINTED CIRCUIT BOARDS

[75] Inventors: Yasuhiro Kataoka, Yokohama; Terumi Nakashima, Takatuski; Narihiko Hashimoto, Nagoya, all of Japan

[73] Assignees: Sony Corporation, Shinagawa-ku; Japan Solderless Terminal MFG. Co., Osaka, both of Japan

[21] Appl. No.: 08/924,939

[22] Filed: Sep. 8, 1997

[30] Foreign Application Priority Data

Nov. 11, 1996 [JP] Japan ..... 8-314182
Apr. 1, 1997 [JP] Japan ..... 9-099837

[51] Int. Cl.[7] ..... H01R 9/09

[52] U.S. Cl. ..... 439/83; 439/74

[58] Field of Search ..... 439/74, 66, 83, 439/247

[56] References Cited

U.S. PATENT DOCUMENTS 5,201,663 4/1993 Kikuchi et al. ..... 439/83

FOREIGN PATENT DOCUMENTS 6163125 6/1994 Japan .
650261 7/1994 Japan .
7263091 10/1995 Japan .

*Primary Examiner*—Kheim Nguyen
*Assistant Examiner*—Michael C. Zarroli
*Attorney, Agent, or Firm*—W. F. Fasse; W. G. Fasse

[57] ABSTRACT

A compact electrical connector having a reduced packaging or mounting area includes a housing in which a receptor cavity for receiving a counterpart connector is concavely formed, and contacts fixed in the housing. Each contact includes a contact body that extends in the plug-in direction in which the counterpart connector is received or plugged into the receptor cavity of the housing, and a contact leg that extends outwardly on the base side of the housing. The housing is provided with a slit or slits through side walls thereof to expose the contact bodies to the outside. Thereby the contacts are deflectable. The slits also partially or entirely separate upper and lower portions of the housing from each other, so that the upper housing portion may easily be deflected laterally or rotationally relative to the lower housing portion. Thereby a misalignment-compensating function is achieved.

23 Claims, 7 Drawing Sheets

CONNECTOR FOR PRINTED CIRCUIT BOARDS

BACKGROUND OF THE INVENTION

1. Field of the Invention

The present invention relates to connectors that are packaged or mounted on substrates such as printed-circuit boards, and in particular, relates to a connector having a reduced packaging area or mounting footprint area while retaining a misalignment-compensating function, i.e. the ability of accepting a counterpart connector with some degree of misalignment.

2. Earlier Technology

In relation to a structure for electrically and mechanically connecting a pair of substrates, it is widely practiced, for example, to package or mount a concave or female type connector on one substrate and a convex or male type connector on another substrate, and to engage these connectors so as to press the bodies of contacts of the respective connectors against each other. In such a connecting structure, however, if the mounting position of the above mentioned connector on one substrate or the mounting position of the counterpart connector on the other substrate is misaligned even just a little, due to, for example, production errors, etc., this will lead to a forced engagement of the connectors with each other. Such a forced engagement of the pair of connectors will exert excessive stresses on the legs of the contacts of the respective connectors and may cause the legs to come off the substrates or other problems.

A connecting structure different in basic construction from the above mentioned connector, is described in Japanese Provisional Patent Publication No. HEI 6-163125, for example. Therein, a first connector having pin-shaped posts and a second connector for receiving such posts are provided and are used to connect two substrates. Each contact of the post-receiving connector includes a U-shaped spring portion at its middle, and the housing of the post-receiving connector is arranged to be moved sidewise by a deflection of the U-shaped spring portion. This structure can exhibit a function of receiving the counterpart connector even when the mounting position of the connector on the substrate is misaligned a little (hereinafter this function is called a misalignment-compensating function). Hence it can prevent excessive stresses from being exerted on the legs of the contacts and, in turn, can prevent separation of the legs.

The connector according to the above mentioned publication, however, suffers a major disadvantage. Namely, this connector has increased external dimensions due to the dimensions of the U-shaped spring portions that are added to the connector. This is contrary to the requirement of users who desire to reduce the packaging area or mounting footprint as much as possible so as to make the substrate more compact.

On the other hand, it is generally required by the users of such connectors that the surfaces of all of the contact legs of the connector that contact the substrate must be in the same plane. This alignment of the contacting surfaces of the legs of all the contacts of a single connector is normally expressed as "achievement of coplanarity." Manufacturers of connectors have been striving to stably achieve coplanarity for every product in the production stage, and to prevent any deformation of the legs as much as possible in the stage of production or delivery to improve the quality of their products.

SUMMARY OF THE INVENTION

The present invention aims to achieve the following objects, by partly exposing the bodies of the contacts fixed in the housing of a connector:

- to achieve a misalignment-compensating function that compensates for any misalignment of a connector in terms of a rotational orientation or a shifted position in a plane parallel to the substrate, by allowing a compensating deflection of the bodies of the contacts,
- to make the connector more compact and reduce its mounting footprint or packaging area, and
- to secure ample rigidity of the connector against compressive force.

To achieve the above objects, the connector according to the present invention is adapted to be mounted on a substrate. This connector comprises a housing having a receptor cavity for receiving a counterpart connector formed concavely therein, and further comprises contacts fixed in the housing. The above mentioned contacts each include a contact body that extends in the above mentioned receptor cavity of the housing in a so-called plug-in direction in which the counterpart connector is received or plugged into the receptor cavity, and a contact leg that extends outwardly on a base side of the housing. The above mentioned housing has slits therein to expose the above mentioned bodies to the exterior of the housing.

With the above mentioned arrangement, the portions of the contact bodies that are exposed through the slits can be deflected in various directions without being restrained by the housing. Hence the housing portion on the opening side of the receptor cavity can be deformed or deflected, relative to the housing portion on the substrate side, in terms of a rotational deflection and a shifting deflection in a plane parallel to the substrate. As a result, the above mentioned connector can exhibit an excellent misalignment-compensating function. The contact body can be of a simpler shape than the prior art contact having a U-shaped spring portion described above. Thus, the housing is more compact and the packaging area of the connector can be reduced. When the housing additionally includes portions in which a slit is not provided, the housing is continuous through these portions in the above mentioned plug-in direction of receiving the counterpart connector. Thus, the connector can provide a rigidity sufficient to cope with a compressive force being applied in the plug-in direction of receiving the counterpart connector. In another embodiment, wherein slits are provided circumferentially over the entire side walls of the housing, the connector can have a rigidity sufficient to cope with the above mentioned compressive force by properly adjusting the rigidity of the contacts thereof.

PREFERRED EMBODIMENTS OF THE INVENTION

In the following, embodiments of the present invention will be described with reference to the attached drawings.

Figure 1:
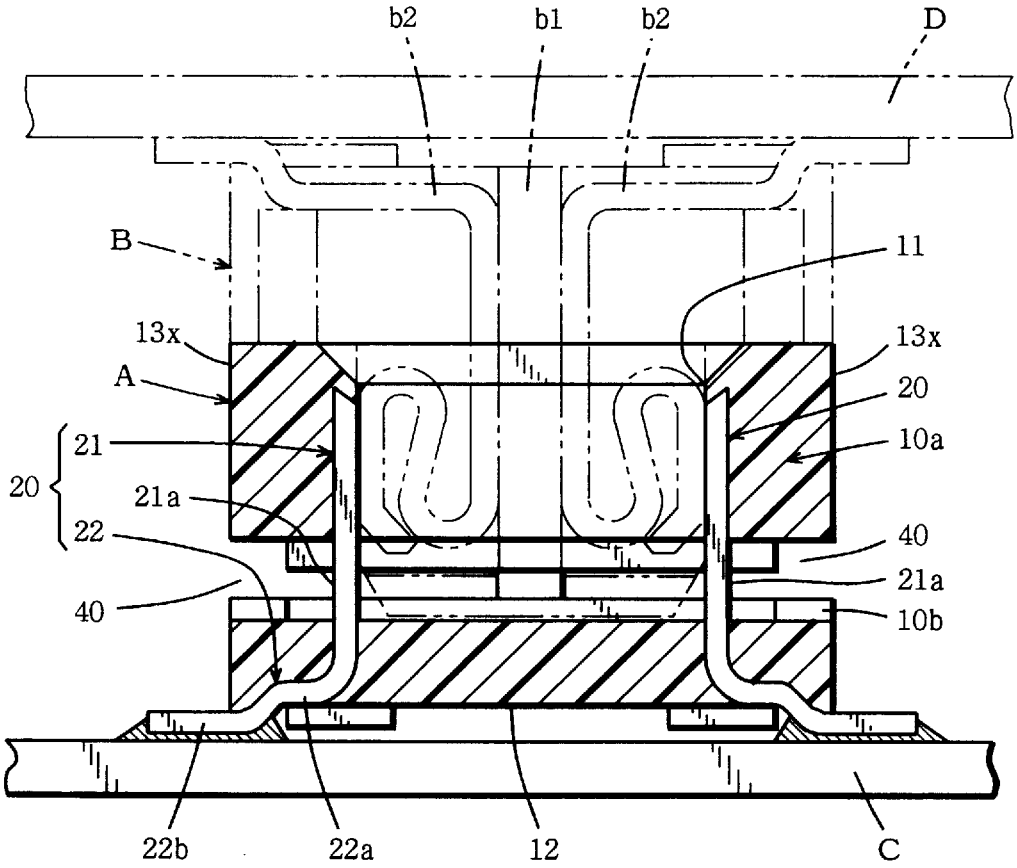
FIG. 1 is a vertical sectional view of a connector of a first embodiment of the invention, mounted on a substrate and fully fitted with a counterpart connector. The section is taken along a section line I—I of FIG. 3.
Figure 2:
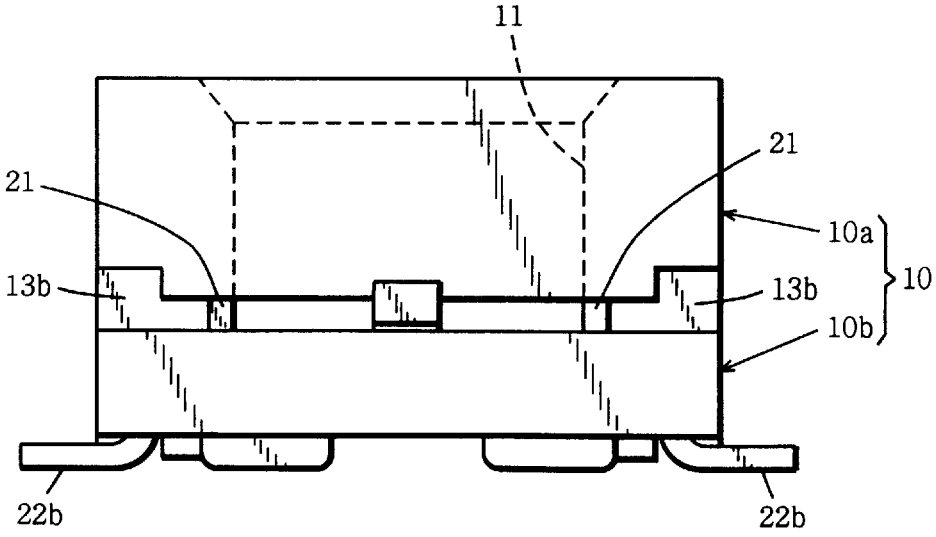
FIG. 2 is a front view of the first embodiment.

FIG. 1 through FIG. 5 show a connector A of the first embodiment. As shown in FIG. 1, this connector A is mounted on a substrate C by soldering. The connector A comprises a housing 10 that is formed of an insulator such as synthetic resins. The housing 10 is formed approximately into the shape of a box having an opening on the top. A receptor cavity 11 for receiving a counterpart connector B is formed by a cavity at the center of the housing 10.

In the housing 10 are fixed a large number of contacts 20 at specified intervals, the contacts 20 being made of a conducting material such as phosphor bronze and, if necessary, electroplated with gold. Each contact 20 comprises a contact body 21 that extends in the so-called plug-in direction in which the counterpart connector B is received or plugged into the receptor cavity 11 of the connector A (corresponding to the vertical direction in FIG. 1). The contact body 21 is fixed on the inner surface of the receptor cavity 11. Each contact 20 further comprises a contact leg 22 that is continuous to the contact body 21 and extends outwardly from the housing 10 along the substrate C. The contacts 20 are fixed to the housing 10 by adhesion of the resin material of the housing 10.

Figure 3:
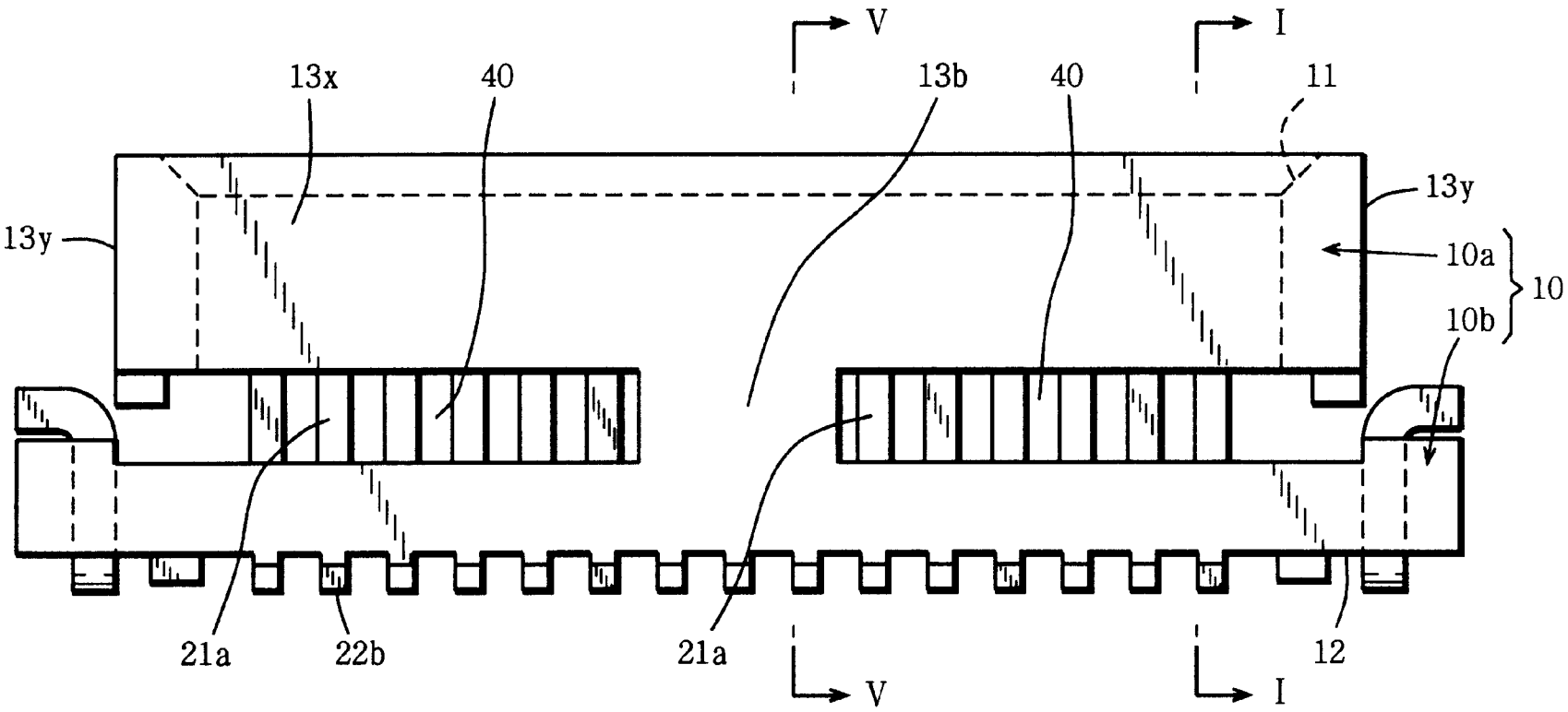
FIG. 3 is a side view of the first embodiment.
Figure 4:
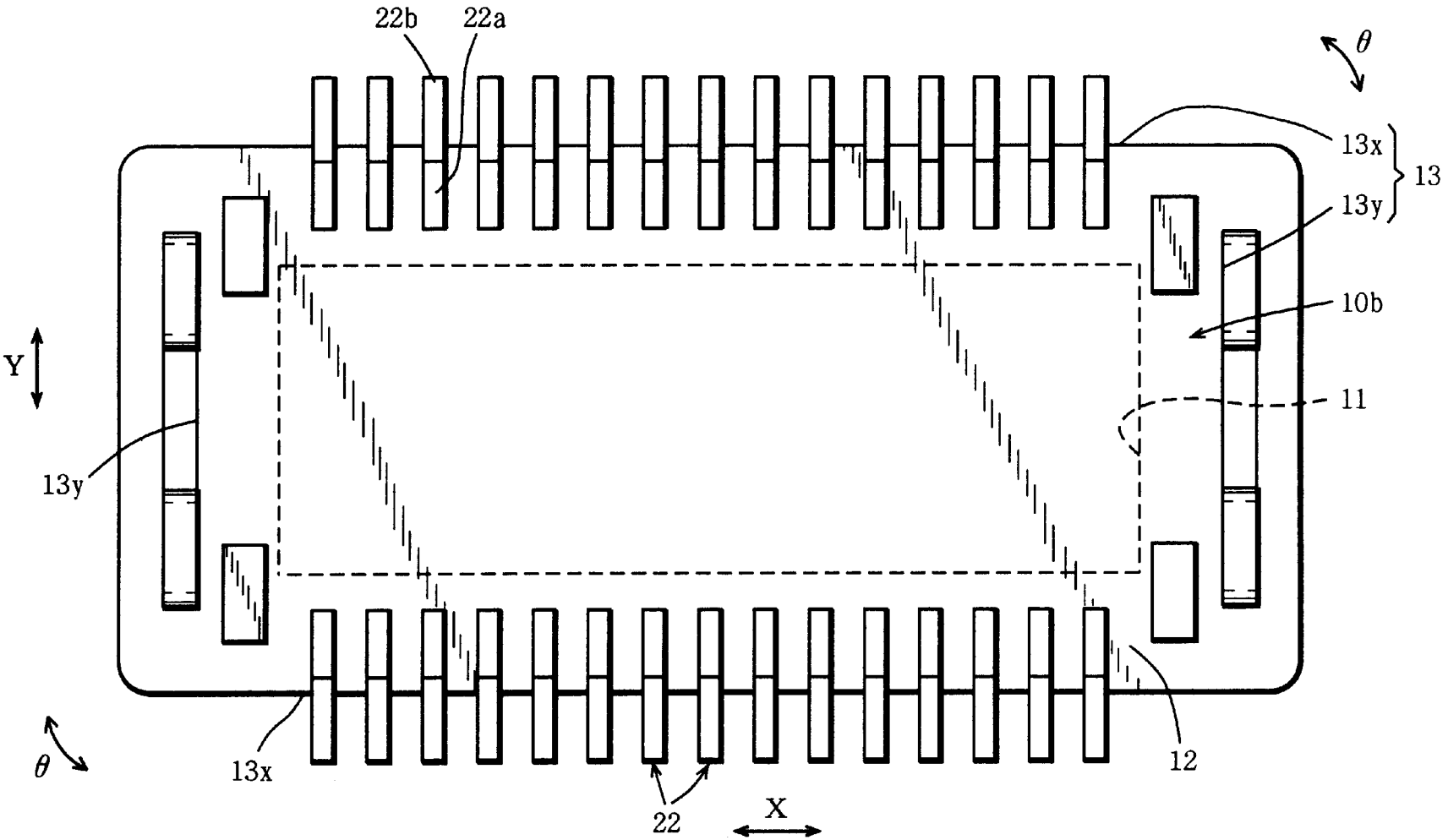
FIG. 4 is a bottom view of the first embodiment.
Figure 5:
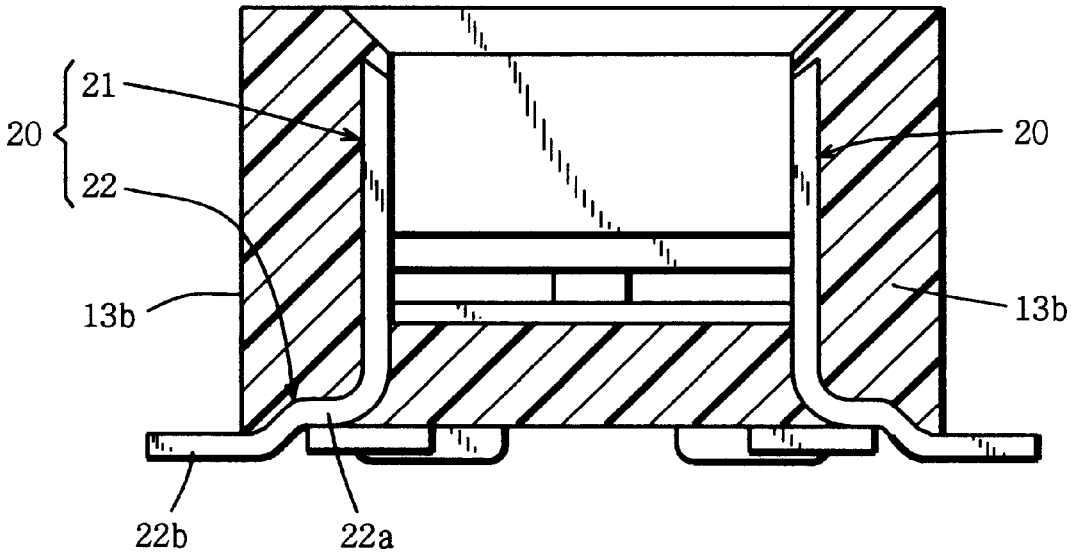
FIG. 5 is a sectional view of the first embodiment taken along a section line V—V of FIG. 3.

The housing 10 is provided with slits 40 extending parallel to a plane of the substrate C, whereby the slits 40 expose the above mentioned contact bodies 21 to the outside of the housing 10. Also, the internal space of the receptor cavity 11 is connected with the outside through gaps between the contact bodies 21 along the slits 40. As shown in FIGS. 3 and 4, when seen in the so-called plug-in direction of receiving the counterpart connector, the housing includes two longer side walls 13*x*, 13*x* and two shorter side walls 13*y*, 13*y*. The housing further includes a floor or base 12. The above mentioned slit 40 is provided to cut entirely across the shorter side wall 13*y* (see FIGS. 2 and 3), and to cut almost halfway across the longer side walls 13*x*, 13*x* (see FIG. 3). Thus a bridge 13*b* that extends in the plug-in direction of receiving the counterpart connector is formed between two slits 40, 40 on the respective longer side walls 13*x*.

The housing 10 can be seen as being comprised of two parts, namely an upper housing 10*a* and a lower housing 10*b* including the base 12, which are divided by the slits 40, 40 and interconnected by bridges 13*b*, 13*b*. The upper housing 10*a* and the lower housing 10*b* are also connected with each other by the contact bodies 21 of the above mentioned contacts 20, in addition to the bridges 13*b*, 13*b*. In FIG. 3, the bridge 13*b* is provided at the approximate center in the longitudinal direction of the longer side wall 13*x*. The bridge 13*b*, however, may be shifted away from the center toward either end in the longitudinal direction of the longer side wall 13*x*.

The contact leg 22 of each above mentioned contact 20 comprises a bottom portion 22*a* extending parallel to said substrate and embedded in the base 12 of the housing 10, and an offset portion 22*b* extending away from the bottom portion 22*a* toward the substrate C and then extending outwardly away from the housing parallel to the substrate C.

The above mentioned connector A is produced by first arranging the contacts 20 in a mold and then molding the housing 10. For example, when the housing 10 is molded out of a synthetic resin, contacts 20 are arranged in an injection mold, then the mold is closed, and the synthetic resin is injected into the mold to mold the housing 10. Thereby, the connector A is produced in a single stroke. Also thereby, the contacts 20 are molded and adhered directly into the housing 10.

When the above mentioned connector A is used, it is mounted onto a substrate C, as shown in FIG. 1, by soldering the offset portions 22*b* of the contact legs 22 to the surface of the substrate C. A counterpart connector B comprises, for example, a housing b1 and contacts b2, and is mounted on a substrate D by soldering the contacts b2 to the substrate D. When this counterpart connector B is inserted into the above mentioned receptor cavity 11 of the connector A, the bodies of the contacts of the respective connectors will be pressed against each other, so as to connect the substrates C and D together electrically and mechanically. The counterpart connector B is produced by a procedure that is almost the same as that for the connector A. Particularly, the connector B may be manufactured by either of two procedures, which may be selected as needed. In the first procedure, the housing b1 is molded after the contacts b2 have been arranged in a mold for the housing b1. In the second procedure, the contacts b2 are assembled in the housing b1 after the housing b1 has been molded by itself.

In the first embodiment of the invention described above, the contact bodies 21 of the contacts 20 include portions 21*a* that are exposed at the slits 40 so that these portions 21*a* can be deflected in various directions without being restrained by the housing 10. As a result, the upper housing 10*a*, which is on the opening side of the receptor cavity 11, can be shifted, relative to the lower housing 10*b* on the substrate side, in a rotating direction and in lateral directions on a plane parallel to the substrate C. Hence the connector A exhibits excellent misalignment-compensating functions, as shown by arrows in FIG. 4, in the lateral direction X that is the direction in which the contacts 20 are arranged, the lateral direction Y that is perpendicular to the direction X, and the rotating direction θ in the plane parallel to the substrate. Moreover, since the present contact body 21 has a simpler configuration than the prior art contact having a U-shaped spring portion described above, therefore, the housing 10 can be made more compact, and in turn, the mounting area of the connector A can be reduced.

The upper housing 10*a* and the lower housing 10*b* are joined to each other not only by the contact bodies 21 but also by the bridges 13*b*, 13*b* in the plug-in direction in which the counterpart connector is plugged into the receptor cavity 11. Hence the connector A is provided with a sufficient rigidity to withstand the compressive force exerted in the plug-in direction of receiving the counterpart connector. Thus when the counterpart connector B is inserted into the receptor cavity 11 of the connector A to connect the substrate C and the substrate D together, the connector A can reliably bear the compressive force exerted in the plug-in direction of receiving the counterpart connector.

Furthermore, the slit 40 crosses over the shorter side wall 13*y* and rounds the corners and extends into the longer side walls 13*x*, and thus the bridges 13*b* are present in the longer side walls 13*x*. Hence the upper housing 10*a* can shift easily relative to the lower housing 10*b*, with the bridges 13*b* serving as the approximate center of rotation. These bridges 13*b* have the highest rigidity in the housing section plane extending along and including the slits 40. The connector A, therefore, exhibits a satisfactory misalignment-compensating function in the rotating direction θ described above. In particular, in enhancing the misalignment-compensating function of the connector A in the rotating direction θ, it is advantageous to locate the bridges 13*b* at the approximate center in the longitudinal direction of the longer side walls 13*x*.

Since at least the greater part of each offset portion 22*b* of each contact 20 is located on the outside of the housing 10, a reactive force that is generated in each offset portion 22*b* in response to a torque applied to the upper housing 10*a* in the direction θ will be small. As a result, when the connector A exhibits the misalignment-compensating function, the above mentioned reactive forces will be received safely and the offset portions 22*b* will be effectively prevented from being peeled off or separated from the substrate. Thus, the practical effectiveness of the misalignment-compensating function of the connector A is enhanced. Moreover, as at least the greater part of each offset portion 22*b* is outside the housing 10, it gives a good visibility of the portions to be soldered, so that it is easy to solder and verify the state of soldering.

Further, when compared with a contact leg of which a bottom portion 22*a* is just extended outwardly without providing any offset portion 22*b*, the above mentioned inventive leg 22 allows one to achieve coplanarity with more ease. The reason is that, the only portion of the above mentioned leg 22 that contacts the substrate C is the offset portion 22*b* and is shorter than the entirety of the offset portion plus the bottom portion. In addition, since the bottom portions 22*a* are supported by the housing base 12, the contact legs 22 will be hardly deformed during the stages of production and delivery of the connector A.

Moreover, as the contacts 20 are positioned by utilizing the mold when the contacts are directly molded into the housing, coplanarity will be stabilized further, and the contacts 20 will be arranged at correct intervals or pitches. As residual stresses are hardly generated in the housing around the contacts during the molding, deformation of the connector A after molding will be prevented. Furthermore, as there is no subsequent process of assembling the contacts 20 into the housing 10, any deformation of the legs 22 in the stage of production of the connector A will be prevented.

Next, FIG. 6 through FIG. 9 show a connector A of a second embodiment. The same reference characters are given to the components that exhibit functions identical to those of the above mentioned first embodiment, and their explanations are omitted.

In the housing 10 of the second embodiment, a slit 40 is formed to extend continuously around the entire side walls 13*x*, 13*y*, 13*x*, 13*y* of the housing 10. Thus the insulating material of the middle portion of the housing 10 as considered in a height direction, i.e. in the plug-in direction of receiving the counterpart connector is eliminated by the slit 40. The housing 10 is divided completely by the slit 40 into two portions, namely an upper housing 10*a* and a lower housing 10*b*, in the plug-in direction of receiving the counterpart connector. The divided housing portions 10*a* and 10*b* are connected together by the above mentioned contact bodies 21. In the drawings, 14, 14 denote openings formed in side walls of the upper housing to facilitate material flow during molding. It, however, is not always necessary to provide these openings.

The contact leg 22 comprises a bottom portion 22*a* that runs along the base 12 of the housing 10 and a riser portion 22*c* that rises from an outwardly directed end of the bottom portion 22*a*. The riser portions 22*c* are retained in grooves 13*a* concavely formed in the housing side walls 13*x*, 13*x*. This arrangement prevents the riser portions 22*c* from increasing the maximum width of the housing as measured between the side walls 13*x*. In the drawings, 21*b* denotes a neck provided by reducing the sectional area in the middle of the contact body 21. It is intended that the housing material will fill up the spaces around the necks 21*b* during the molding process to increase the bonding power between the contacts 20 and the housing 10. It, however, is not always necessary to provide these necks.

The above mentioned connector A of the second embodiment is produced, just like the connector of the first embodiment, by first arranging contacts 20 in a mold for the housing 10 and then molding the housing 10. The method of use of the connector A is also similar to that of the connector of the first embodiment, but mounting of the connector A onto the substrate C is effected by soldering the bottom portions 22*a* of the contact legs 22 onto the surface of the substrate C.

In the second embodiment described above, the exposed portions 21*a* of the contact bodies 21 of the contacts 20 will be able to be deflected in various directions without being restrained by the housing 10. Hence the upper housing 10*a* can shift, relative to the lower housing 10*b*, in the rotating direction and in lateral directions in a plane parallel to the substrate C as discussed above in connection with the first embodiment. Because of this, the connector A exhibits excellent misalignment-compensating functions, as shown by arrows in FIG. 9, in the lateral direction X that is the direction of arrangement of the contacts 20, the lateral direction Y that is perpendicular to the direction X, and, in particular, the rotating direction θ within the plane. When the rigidity of the contacts 20 is adjusted or selected properly, an overall rigidity of the connector A sufficient to bear the compressive force exerted in the plug-in direction of receiving the counterpart connector will be provided. Thus the connector A will safely bear the compressive force exerted at the time of connecting the substrates C and D together, and satisfactorily exhibit the misalignment-compensating function in the rotating direction θ as well as in the other lateral directions. Moreover, since the inventive contact body 21 may have a simpler configuration than the prior art contact having a U-shaped spring portion described above, therefore the housing 10 can be made more compact, and in turn, the mounting area of the connector A can be reduced.

Figure 6:
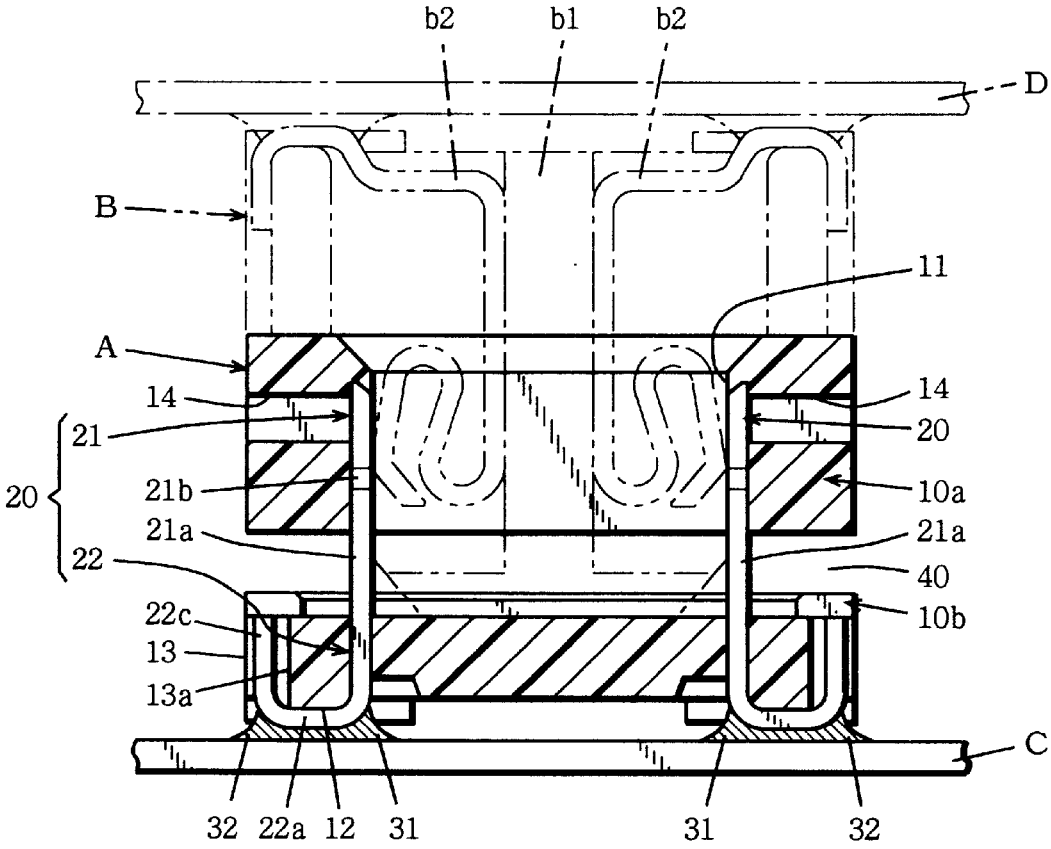
FIG. 6 is a vertical sectional view of a connector of a second embodiment of the invention, mounted on a substrate and fully fitted with a counterpart connector.
Figure 7:
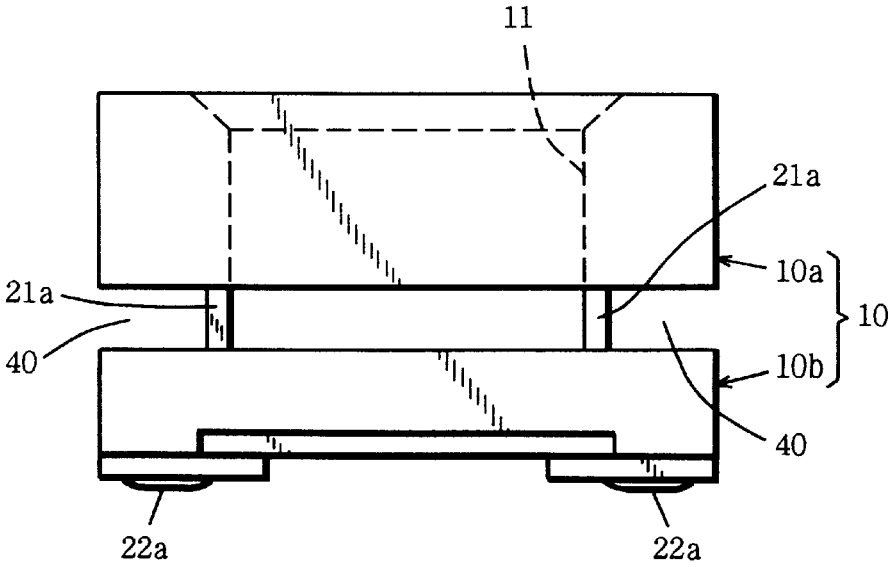
FIG. 7 is a front view of the second embodiment.
Figure 8:
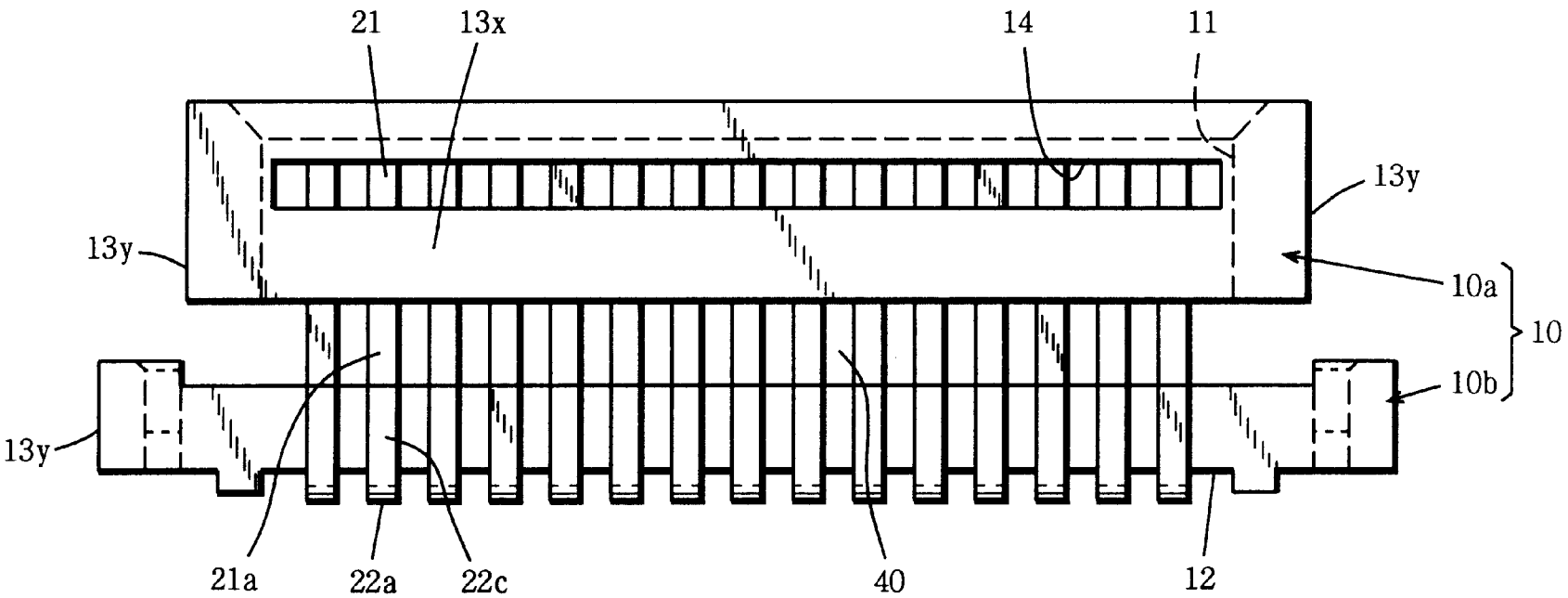
FIG. 8 is a side view of the second embodiment.
Figure 9:
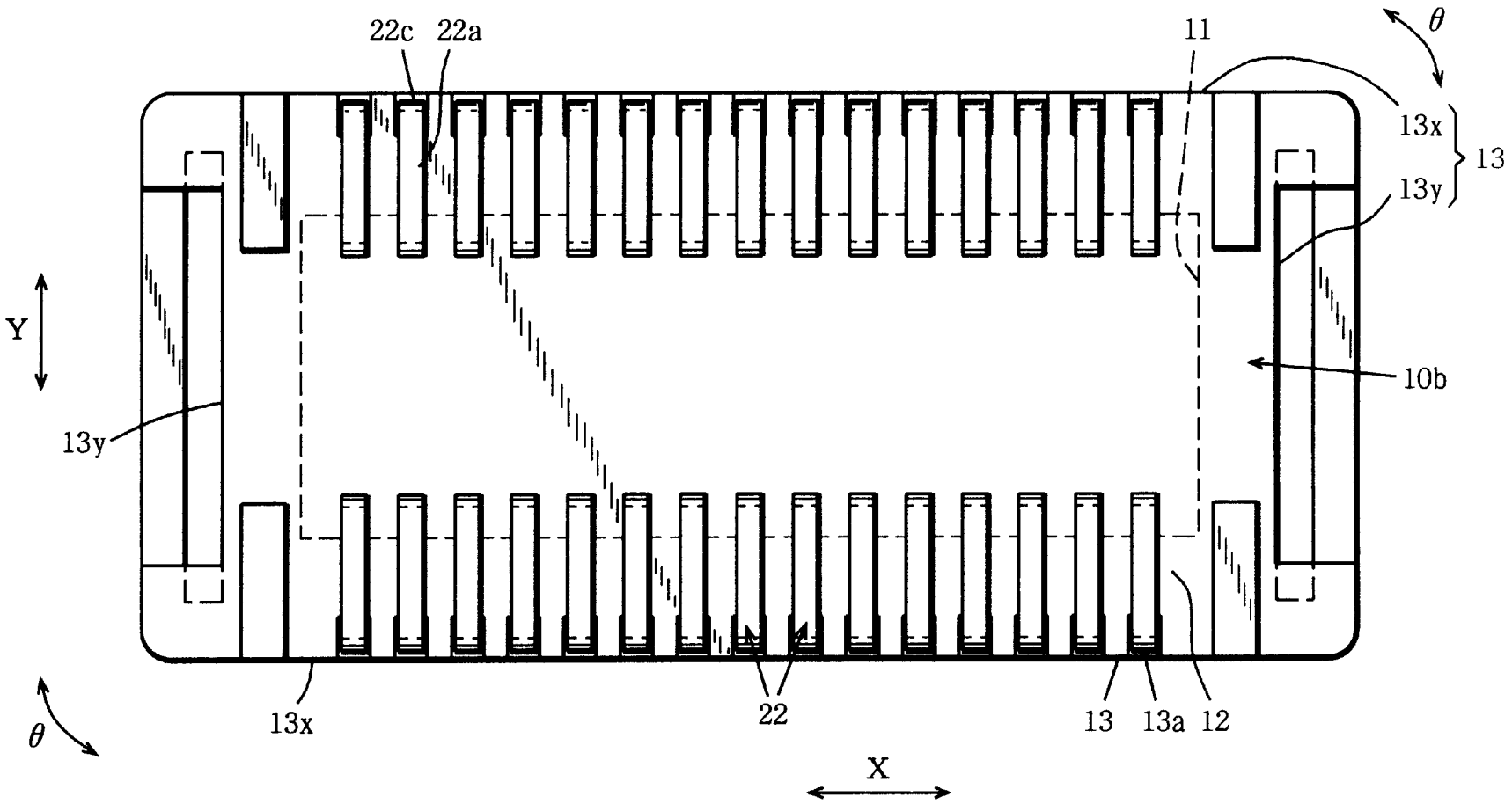
FIG. 9 is a bottom view of the second embodiment.

As shown in FIG. 6, solder fillets 31, 32 are formed at two points near both ends of the bottom portion 22*a* of each contact leg 22. This increases the bonding power of the solder between the contact legs 22 and the substrate C and stabilizes the adhesion of the contact legs 22 to the substrate C. Hence a reactive force that is generated in each contact leg 22 when the connector A exhibits the misalignment-compensating function will be received safely to reliably prevent the bottom portions 22*a* from being peeled off or separated from the substrate C.

Further, when compared with a configuration in which a contact leg has a bottom portion 22*a* that is just extended outwardly without providing a riser portion 22*c*, the above mentioned inventive leg 22 makes it easier to achieve coplanarity. The reason is that, the only portion of the above mentioned leg 22 that contacts the substrate C is the bottom portion 22*a* and is shorter than would be the case with a laterally protruding bottom portion. In addition, as the bottom portions 22*a* are supported by the housing base 12, the contact legs 22 will hardly be deformed during the stages of production and delivery of the connector A.

As the above mentioned riser portions 22*c* are retained in grooves 13*a* concavely formed in the housing side walls, the legs 22 of the contacts 20 are within the contours of the housing 10 and the packaging or mounting area of the connector is reduced further. Moreover, as the riser portions 22*c* are protected by the grooves 13*a*, the contact legs 22 will hardly be deformed in the stage of production or delivery of the connector A.

Furthermore, in the case of the above mentioned connector A according to the second embodiment, as the contacts 20 are positioned by utilizing the mold when the contacts are directly molded into the housing, coplanarity will be stabilized further, and the contacts 20 will be arranged at correct intervals or pitches. As residual stresses are hardly generated in the housing around the contacts during molding, distortion of the connector A after molding will be prevented. Moreover, as there is no subsequent process of assembling the contacts 20 into the housing 10, any deformation of the contact legs 22 in the stage of production of the connector A will be prevented.

The present invention is not limited in any way by the two embodiments described above. The present invention includes all connectors within the scope of the appended claims, and particularly connectors including contacts arranged in a housing, wherein the contacts comprise a contact body and a contact leg and the housing is provided with a slit or slits to expose the contact bodies. The invention extends to embodiments combining features from different embodiments described herein. For example, the invention includes: a third embodiment wherein the housing of the above mentioned first embodiment and the contact legs of the second embodiment are combined with each other; a fourth embodiment wherein the housing of the above mentioned second embodiment and the contact legs of the first embodiment are combined with each other; a fifth embodiment having the contact leg described in the first embodiment with a riser provided at the top end of the offset portion of the contact leg; a sixth embodiment wherein the contact leg described in the second embodiment is provided, the housing is not provided with grooves, and the riser portions of the contact legs and the housing side walls are separated from each other; a seventh embodiment wherein the contact leg described in the second embodiment is provided, no riser portion is provided and the bottom portion of the leg is just extended outwardly; and further embodiments wherein the housing base and the bottoms of the legs are kept apart from each other in the first and second embodiments. The width of the bridge may be selected freely as desired, and is not limited by the above mentioned first embodiment.

In the above mentioned embodiments, the contacts 20 are fixed in the housing 10 by first arranging the contacts 20 in the mold for the housing 10 and then molding the housing 10 in this mold. Alternatively, it is possible to first mold the housings 10*a* and 10*b* separately and without the contacts 20, and then insert contacts 20 into the housings 10*a* and 10*b* to assemble the connector. It is also possible to first arrange the contacts in the mold for either the housing 10*a* or the housing 10*b*, and then mold either the housing 10*a* or the housing 10*b* to fix the contacts 20 in either the housing 10*a* or the housing 10*b*, and thereafter insert the contacts 20 into the remaining housing 10*b* or 10*a* to assemble the connector. Moreover, in the above mentioned embodiments, the housing 10 is divided into two parts, namely, the upper housing 10*a* and the lower housing 10*b*, and they are joined to each other by the contact bodies 21 of the contacts 20. It, however, is possible to divide the housing into three or more parts in the plug-in direction of receiving the counterpart connector and to join these divided housings with contact bodies. In this case, a function and effect similar to those of the above mentioned embodiments are obtained. In the above mentioned embodiments, the explanation assumes that substrates are to be connected together. However, it is not always necessary for the counterpart connector to be packaged or mounted on a substrate. Moreover, the sectional shape of the contact may be rectangular or round.

We claim:

1. An electrical connector comprising a housing and a plurality of electrical contacts fixed in said housing, wherein:

said housing comprises side walls surrounding a receptor cavity therebetween, and a base extending between said side walls at a bottom of said receptor cavity;

said receptor cavity is adapted to receive a counterpart connector being plugged into said receptor cavity in a plug-in direction;

each of said contacts respectively comprises a contact body that extends in said plug-in direction in said receptor cavity of said housing, and a contact leg that includes a bottom portion extending from said contact body laterally outwardly along said base of said housing and a riser portion extending upwardly from said bottom portion;

said housing has at least one slit therein through which said contact bodies of said contacts are exposed; and said side walls of said housing have grooves concavely formed therein and said respective riser portions of said contact legs are retained in said grooves.

2. The electrical connector according to claim 1, wherein:

said side walls of said housing comprise two longer side walls and two shorter side walls adjoining one another at respective corners;

said at least one slit includes two slits;

said two slits each respectively extend entirely across a respective one of said shorter side walls, around two of said corners, and partially across said two longer side walls so as to leave a respective bridge of material extending in said plug-in direction in each of said longer side walls.

3. The electrical connector according to claim 1, wherein said at least one slit includes one continuous slit that extends continuously and entirely along each of said side walls of said housing so as to divide said housing into a first housing portion including said receptor cavity therein and a second housing portion including said base, and wherein said contact bodies extend across said slit and interconnect said first and second housing portions.

4. The electrical connector according to claim 1, wherein:

at least a respective portion of each one of said contacts is intimately bonded with a molded material of said housing in an adherent and form-fitting manner as results from said contacts being molded directly into said housing as said housing is being molded.

5. An electrical connector comprising a housing and a plurality of electrical contacts fixed in said housing, wherein:

said housing comprises at least one housing wall surrounding a concave receptor cavity within said housing, and said housing terminates along a base plane at one end thereof and has an opening that opens into said receptor cavity at another end thereof;

said receptor cavity is configured and adapted to receive a counterpart connector being plugged into said receptor cavity in a plug-in direction;

each of said contacts respectively comprises a contact body that extends in said plug-in direction in said receptor cavity of said housing, and a contact leg including at least a leg portion that extends out of said housing at said base plane;

said housing has at least one slit in said housing wall;

said at least one slit extends along a slit plane that is at least one of parallel to said base plane and perpendicular to said plug-in direction; and said at least one slit passes entirely through a thickness of said housing wall from outside of said housing into said receptor cavity within said housing, so as to expose at least respective portions of said contact bodies to said outside through said at least one slit along said slit plane.

6. The electrical connector according to claim 5, wherein each said contact body consists of a single straight linear conductor member that extends in said plug-in direction in said receptor cavity and straight across a gap width of said slit, where said respective contact body is completely free of and unsupported by said housing.

7. The electrical connector according to claim 5, wherein said plug-in direction is perpendicular to said base plane, and said slit plane is both parallel to said base plane and perpendicular to said plug-in direction.

8. The electrical connector according to claim 7, wherein said at least one housing wall is bounded at said outside by a wall surface that extends flushly along a single plane parallel to said plug-in direction on opposite sides of said slit plane.

9. The electrical connector according to claim 5, wherein said at least one slit extends only partially across said at least one housing wall, so that said at least one slit partially divides said housing into a first housing portion, a second housing portion, and at least one housing bridge portion that extends between and interconnects said first and second housing portions in said plug-in direction.

10. The electrical connector according to claim 9, wherein said at least one housing wall comprises two longer side walls and two shorter side walls adjoining one another at respective corners, and wherein said at least one slit includes two non-contiguous slits that each respectively extend along said slit plane entirely across a respective one of said shorter side walls, around two of said corners, and partially across said two longer side walls so as to leave two of said housing bridge portions respectively in said two longer side walls.

11. The electrical connector according to claim 10, wherein said bridge portions are located at lengthwise centers of said two longer side walls.

12. The electrical connector according to claim 9, wherein at least a respective portion of each one of said contacts is intimately bonded with a molded material of said housing in an adherent and form-fitting manner as results from said contacts being molded directly into said housing as said housing is being molded.

13. The electrical connector according to claim 5, wherein said at least one slit comprises one continuous slit that extends along said slit plane continuously and entirely along said at least one housing wall so as to divide said housing completely into a first housing portion and a second housing portion that are separated from each other by said continuous slit, and wherein said respective contact bodies of said contacts span across said slit and interconnect said first and second housing portions to each other.

14. The electrical connector according to claim 13, wherein said contact bodies extend straight and parallel to said plug-in direction across said slit, and provide the only interconnection between said first and second housing portions.

15. The electrical connector according to claim 13, wherein at least a respective portion of each one of said contacts is intimately bonded with a molded material of said housing in an adherent and form-fitting manner as results from said contacts being molded directly into said housing as said housing is being molded.

16. The electrical connector according to claim 5, wherein at least a respective portion of each one of said contacts is intimately bonded with a molded material of said housing in an adherent and form-fitting manner as results from said contacts being molded directly into said housing as said housing is being molded.

17. The electrical connector according to claim 16, wherein said contact bodies respectively include embedded portions that are entirely embedded contiguously into said housing.

18. The electrical connector according to claim 16, wherein said contact bodies each respectively include a neck portion that has a reduced sectional area in comparison to a remainder of said contact body, and said neck portion is intimately engaged by said molded material of said housing.

19. The electrical connector according to claim 5, wherein said housing further includes a base extending along a bottom of said receptor cavity parallel to said base plane, wherein said contact leg of each of said contacts respectively further includes a bottom portion set into said base of said housing, and wherein said leg portion that extends out of said housing is an offset portion that includes a first part extending from said bottom portion in a direction away from said receptor cavity and a second part extending from said first part away from said housing in a direction parallel to said base plane.

20. The electrical connector according to claim 19, wherein each said contact essentially consists of said contact body extending linearly in said plug-in direction, said bottom portion continuing from said contact body and extending parallel to said base plane, and said first and second parts of said offset portion continuing from said bottom portion.

21. The electrical connector according to claim 5, wherein said housing further includes a base extending along a bottom of said receptor cavity parallel to said base plane, wherein said leg portion that extends out of said housing is a bottom portion that extends along an outside of said base parallel to said base plane, and wherein said contact leg of each of said contacts respectively further includes a riser portion that rises from said bottom portion toward said end of said connector having said opening.

22. The electrical connector according to claim 21, wherein said at least one housing wall has grooves in an outer surface thereof, and said risers of said contact legs are respectively retained in said grooves.

23. The electrical connector according to claim 5, wherein said at least one slit at least partially separates said housing into an upper housing portion and a lower housing portion and said contact bodies interconnect said upper and lower housing portions in a direction perpendicular to said base plane, such that said upper housing portion is flexibly deflectable relative to said lower housing portion without interference between said housing portions in two mutually perpendicular lateral directions parallel to said base plane and in a rotation direction about a rotation axis perpendicular to said base plane, and such that said upper housing portion is stiffly connected and not displaceable relative to said lower housing portion in a direction perpendicular to said base plane.

* * * * *